US005993269A

United States Patent [19]

Ito

[11] Patent Number: 5,993,269

[45] Date of Patent: Nov. 30, 1999

[54] CONNECTING PIN HAVING ELECTRICALLY CONDUCTIVE MAGNETIC FLUID

[75] Inventor: Atsushi Ito, Yamagata, Japan

[73] Assignee: NEC Corporation, Tokyo, Japan

[21] Appl. No.: 08/993,630

[22] Filed: Dec. 18, 1997

[30] Foreign Application Priority Data

Dec. 25, 1996 [JP] Japan ..... 8-345045

[51] Int. Cl.[6] ..... H01R 13/24

[52] U.S. Cl. ..... 439/824; 439/179; 277/80

[58] Field of Search ..... 439/824, 520, 439/179; 73/514.08; 188/267; 384/133; 200/233; 77/266; 324/761

[56] References Cited

U.S. PATENT DOCUMENTS

| | | | |
|---|---|---|---|
| 3,435,168 | 3/1969 | Cooney | 200/266 |
| 4,050,762 | 9/1977 | Hines et al. | 439/824 |
| 4,397,519 | 8/1983 | Cooney | 439/824 |
| 4,566,744 | 1/1986 | Engelenberg | 439/5 |
| 4,947,111 | 8/1990 | Higman et al. | 324/158 |
| 5,108,198 | 4/1992 | Nii et al. | 384/133 |
| 5,165,701 | 11/1992 | Koba | 277/80 |
| 5,238,254 | 8/1993 | Takii et al. | 277/80 |
| 5,600,199 | 2/1997 | Martin, Sr. et al. | 313/318.02 |
| 5,675,199 | 10/1997 | Miyakoshi et al. | 310/90 |

OTHER PUBLICATIONS

Trademark Office search for POGO trademark. Two pages, proof of valid and current trademark, Oct. 1998.

Bill of Materials copy from Pylon Company showing POGO pin specifications, Trademark and pertinent U.S. Patent, Jan. 1978.

*Primary Examiner*—Khiem Nguyen
*Assistant Examiner*—Michael C. Zarroli
*Attorney, Agent, or Firm*—Sughrue, Mion, Zinn Macpeak & Seas, PLLC

[57] ABSTRACT

A connector pin which has a structure wherein a pin which can be moved by a spring is kept in contact with a casing by way of connecting member, an electrically conductive magnetic fluid is sustained in the casing, and the casing and the connecting member are magnetized. Owing to this structure, the connector pin is capable of extremely reducing production of metal powders in the casing and has a prolonged service life. Since the electrically conductive magnetic fluid can be sustained by magnetizing the parts composing the connector pin, no sealing member is required for sealing the electrically conductive magnetic fluid and the connector pin has a remarkably simplified structure.

10 Claims, 3 Drawing Sheets

CONNECTING PIN HAVING ELECTRICALLY CONDUCTIVE MAGNETIC FLUID

BACKGROUND OF THE INVENTION

1. Field of the Invention

The present invention relates to an electric connector unit which is comprised in a tester for semiconductor elements and used for connecting a probe card to the tester, and more specifically a connector pin which is to be built in the electric connector unit.

2. Description of the Related Art

LSI chips which are formed on a wafer at a manufacturing step of the LSI chips are subjected to a function test before they are cut off into individual chips. A tester used for this function test will be described with reference to a schematic diagram shown in FIG. 1. In FIG. 1, a tester 100 is composed of a test head 101, a connecting ring 104 and a probe card 106. The test head 101 comprises a power source and a measuring instrument which are used for the test, and a test board 102 which is to be connected to the connecting ring 104 is attached to the test head 101. Probes 105 which are to be brought into contact with a pellet (an LSI chip) 108 on a wafer 107 are disposed at a center of the probe card 106 and connected to pads 110 through wires (not shown). The connecting ring 104 is a part used for electrically connecting the test board 102 to the probe card 106, and connector pins 103 which are studded on a top surface and a bottom surface of the connecting ring 104 are connected to each other in the connecting ring 104. Further, the connector pins 103 are disposed at locations which correspond to pads 109 on the test board 102 and the pads 110 on the probe card 106 respectively. Actually, the connector pins are disposed in 100 to 1000 pairs on the connecting ring 104.

FIG. 2 shows a sectional view of the connecting ring 104. In this drawing, however, only two pairs of connector pins are shown and parts which correspond to those shown in FIG. 1 are represented by the same reference numerals. In FIG. 2, connector pins 103*a* and 103*b* which are disposed in the connecting ring 104 are set in directions reverse to each other and connected by way of a connecting pipe 111. Each of the connector pins 103*a* and 103*b* is composed of a pin 112 which is kept in contact with the pad 109 of the test board 102 or the pad 110 of the probe card 106 and a casing 113 which is kept in contact with the connecting pipe 111. A main body of the connecting pipe 104 has an insulating property though the connector pins 103*a*, 103*b* and the connecting pipe 111 are made of a metal. In other words, the connecting pipes 111 for the connector pins are insulated from one another.

In each of the connector pins 103*a* and 103*b*, the pin 112 is kept in contact with the casing 113 inside the casing. Accordingly, an electric current path is formed from the pad 109 on the test board 102 to the pad 110 on the probe card 106.

The connector pin 103*a* or 103*b* described above has a structure wherein the pin 112 and the casing 113 are kept in contact with each other. Therefore, the connector pin poses a problem that portions of the pin 112 and the casing 113 which are kept in contact with each other are abraded due to friction between the metal parts, thereby causing poor contact or malfunction of the pin 112 due to metal powders.

SUMMARY OF THE INVENTION

A primary object of the present invention is therefore to provide a connector pin which is configured so that it is capable of preventing improper electrical conduction.

Another object of the present invention is to provide a connector pin which is configured so that it is capable of preventing improper electrical conduction, has a simple structure and can be studded at a high density on a connecting ring.

Still another object of the present invention is to provide a connector unit in which connector pins free from improper electrical conduction are mounted at a high density.

For accomplishing the objects described above, the connector pin according to the present invention comprises a pin being supported with a spring and movable in an elongating/contracting direction of the spring, a cylindrical casing accommodating the pin, and a connecting member being connected to the pin and being kept in contact with an inside surface of the casing; the connector pin being characterized in that the connecting member and the casing are magnetized, and that an electrically conductive magnetic fluid is sustained in the casing.

Further, the connector unit according to the present invention is composed of a first connector pin which is disposed at a location corresponding to a connecting pad on a first substrate, a second connector pin which is disposed at a location corresponding to a connecting pad on a second substrate and connecting means which connects the first connector pin to the second connector pin; the connector unit being characterized in that each of the first connector pin and the second connector pin comprises a pin being supported with a spring and movable in an elongating/contracting direction of the spring, a cylindrical casing accommodating the pin, and a connecting member being connected to the pin and being kept in contact with an inside surface of the casing, and that the connecting member and the casing are magnetized and an electrically conductive magnetic fluid is sustained in the casing.

Since the connector pin according to the present invention uses the electrically conductive magnetic fluid, it is capable of largely reducing the production of metal powders and can have a prolonged service life. Further, since the electrically conductive magnetic fluid can be sustained by magnetizing the parts which compose the connector pin, it is unnecessary to use a sealing member for sealing the electrically conductive magnetic fluid and the connector pin can have a remarkably simplified structure.

BRIEF DESCRIPTION OF THE DRAWINGS

The above and other objects, features and advantages of the present invention will be more apparent from the following description taken in conjunction with the accompanying drawings, in which.

DETAILED DESCRIPTION OF THE PREFERRED EMBODIMENT

Figure 1:
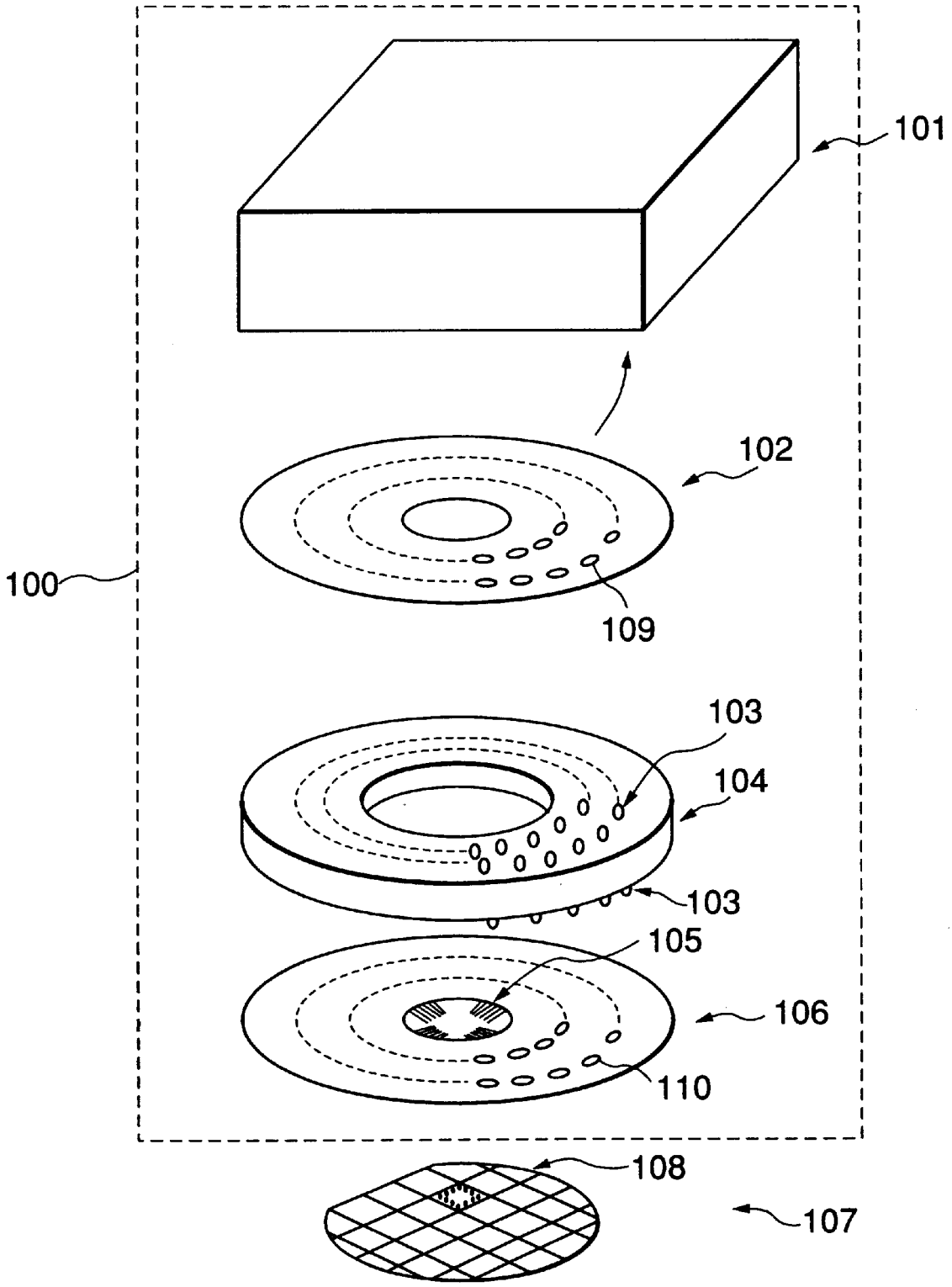
FIG. 1 is an exploded view illustrating a semiconductor tester.
Figure 2:
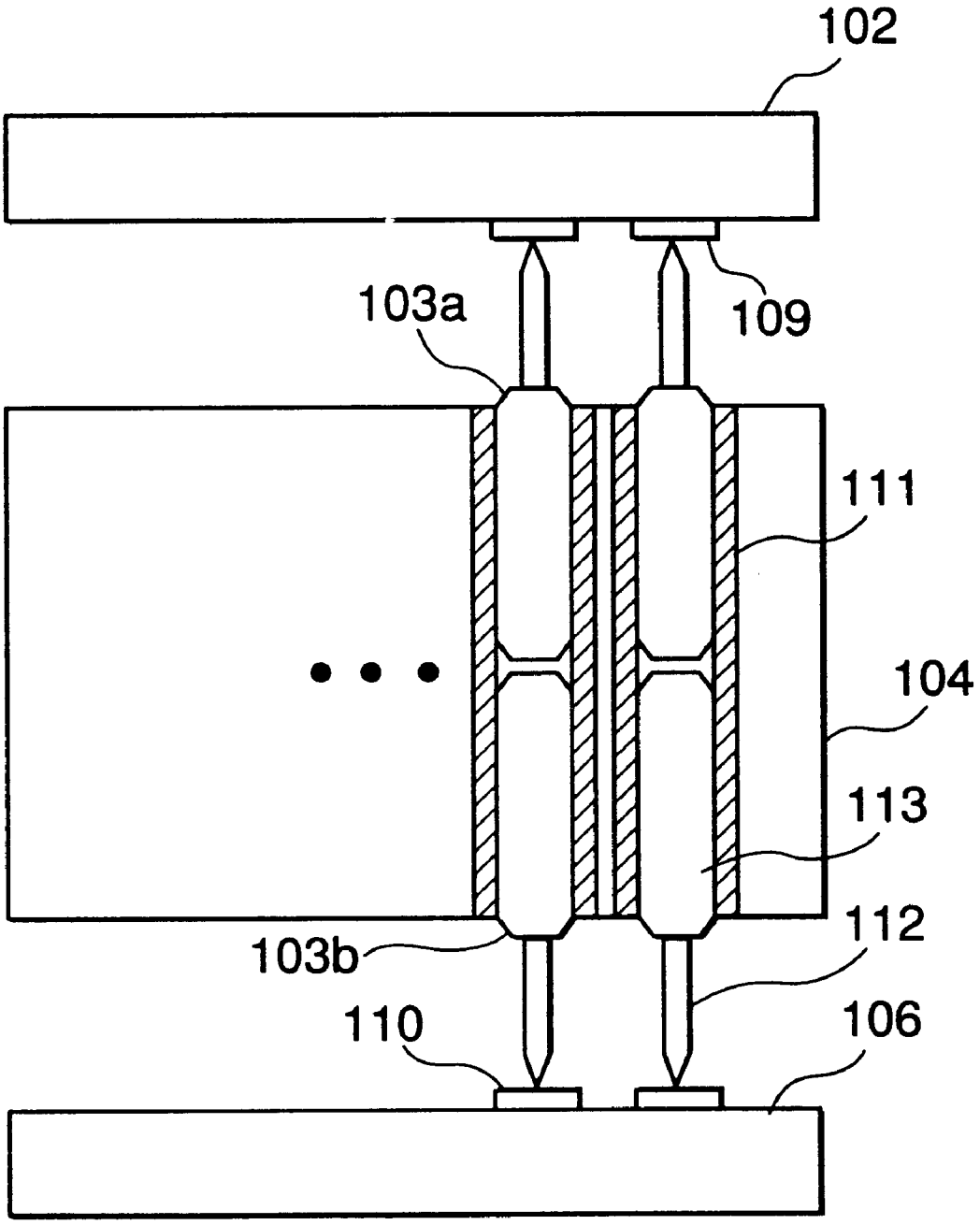
FIG. 2 is a sectional view illustrating a connecting ring.
Figure 3:
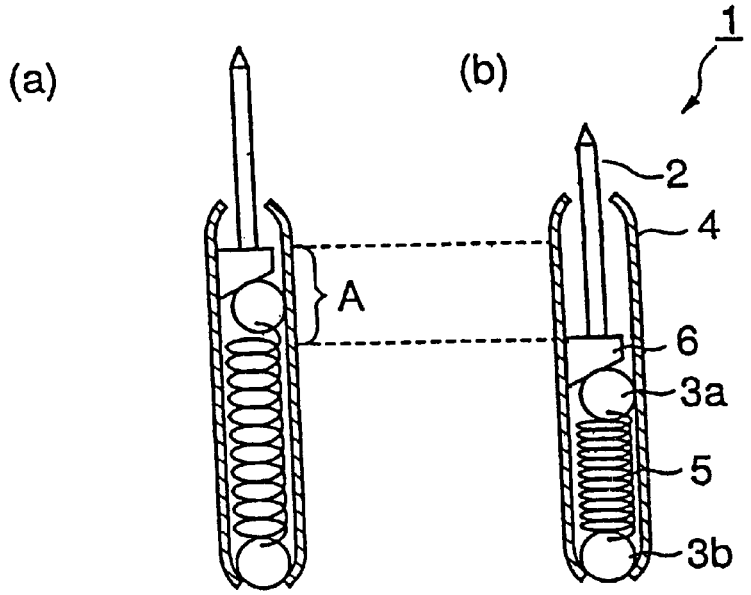
Fig.3 (PRIOR ART)
FIGS. 3(*a*) and 3(*b*) are sectional views illustrating a conventional connector pin in conditions where it is unloaded and loaded respectively.

Prior to description of the embodiment of the present invention, a conventional connector pin will be described in details. FIGS. 3(*a*) and 3(*b*) show sectional views of the conventional connector pin. A connector pin 1 is formed by setting a ball 3*b,* a spring 5, a ball 3*a,* a fixing table 6 and a pin 2 in this order into a cylindrical casing 4 which is made of a metal. The pin 2 and the fixing table 6 are connected to each other in advance. After these parts have been set in the casing 4, both ends of the casing 4 are narrowed to prevent the parts from coming out. The ball 3*b* functions as an end cap which prevents the spring 5 from protruding. Further, the pin 2 is connected to the casing 4 by pressing the ball 3*a* against the casing 4 with the fixing table 6. In FIGS. 3(*a*) and 3(*b*), the pin 2 is moved within an operation range A by the spring 5 which elongates and contracts.

The connector pin according to the prior art poses a problem that when the pin 2 is moved repeatedly within the operation range A, the connector pin cannot maintain electrical conduction due to poor contact among the fixing table 6, ball 3*a* and casing 4 or malfunction of the connector pin. The poor contact is caused by abrasion of the metal due to friction between the metal parts and the malfunction of the connector pin is caused by metal powders produced due to the abrasion.

When the casing 4 is filled with an electrically conductive fluid and its opening is sealed for solving this problem, there is posed a problem that the pin 2 cannot operate smooth due to friction between a sealing member and the pin 2 and reduces a mounting margin. When a spring modulus of the spring 5 is enhanced for solving this problem, there is posed a problem that it injures pads on a substrate.

Now, detailed description will be made of the connector pin according to the present invention which has been made for solving the problems described above.

Figure 4:
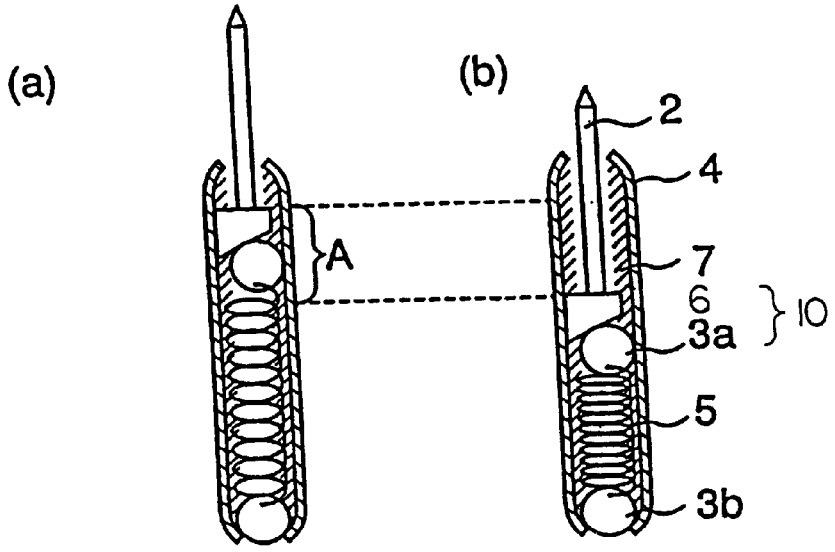
FIGS. 4(*a*) and 4(*b*) are sectional views illustrating the connector pin according to the present invention in conditions where it is unloaded and loaded respectively.

FIGS. 4(*a*) and 4(*b*) show sectional views illustrating the connector pin according to the present invention. Parts of the connector pin according to the present invention which are common to the conventional example shown in FIG. 3 are represented by the same reference numerals and will not be described in particular. FIG. 4(*a*) shows the connector pin in its unloaded condition, whereas FIG. 4(*b*) shows the connector pin in its loaded condition, or a condition where the pin 2 is compressed. A connector pin 1 according to the present invention is composed, like the conventional connector pin, of the pin 2, balls 3*a* and 3*b*, casing 4 and spring 5 which are made of a metal. The fixing table 6 and the ball 3*a* acts as a to connecting member 10 which brings about electrical connection between the pin 2 and the casing 4. In the connector pin according to the present invention, however, an electrically conductive fluid 7 is sustained in the casing 4, and the balls 3*a* and the casing 4 are magnetized. It is desirable that the ball 3*a* and the casing 4 are made of a ferromagnetic metal (iron, nickel, cobalt or an alloy thereof plated with gold) and that mercury is selected as the electrically conductive magnetic fluid 7.

In the present invention, it is desirable to use the electrically conductive magnetic fluid 7 in an amount which is not sufficient to fill up the casing 4 but uniformly covers an inside surface of the casing 4 and the ball 3*a*. When the pin 2 is moved after the electrically conductive magnetic fluid 7 is applied as described above, films of this fluid are formed between the casing 4 and the fixing table 6, between the casing 4 and the ball 3*a* and between the fixing table 6 and the ball 3*a* thereby remarkably reducing coefficients of friction among these metal parts. Further, the electrically conductive magnetic fluid 7 does not constitute a load on the spring 5 and assures an operation range A for the pin 2 which remains unchanged from that of the conventional connector pin. Furthermore, the electrically conductive magnetic fluid 7 is sustained in the casing 4 by magnetism of the casing 4 and that of the ball 3*a* whether the connector pin is in the unloaded condition or the loaded condition. The casing may be magnetized by magnetization or any process by which a magnetic material is magnetized, i.e., electrically, magnets. Accordingly, the connector pin according to the present invention does not require a sealing member which is conventionally used.

The connector pin according to the present invention which has the structure described above exhibits effects enumerated below:

(1) An electrically conductive magnetic fluid serves as a lubricant and prevents metal powders from being produced.

(2) Electrical conduction between the pin and the casing is maintained through the electrically conductive magnetic fluid should metal powders be produced.

(3) A setting direction for the connector pin is not restricted since the electrically conductive magnetic fluid can be sustained in the casing by utilizing magnetism.

(4) No unnecessary load is imposed on the pin operation since a sealing member such as an O ring or a packing is not used for sustaining the electrically conductive magnetic fluid. Further, a mounting density of the connector pin can be enhanced approximately twice as high since no space is required for disposing the sealing member and the connector pin can be configured so as to have a diameter which is shorter than half a diameter of a connector pin using the sealing member.

What is claimed is:

1. A connector pin comprising:

a pin being supported with a spring and movable in an elongating/contracting direction of said spring;

a cylindrical casing accommodating said pin;

a connecting member being connected to said pin and being kept in contact with an inside surface of said cylindrical casing, said connecting member and said cylindrical casing being magnetized; and an electrically conductive magnetic fluid being sustained in said cylindrical casing.

2. The connector pin as claimed in claim 1, wherein said electrically conductive magnetic fluid is not filled in a central section of said cylindrical casing, but covers said connecting member and said inside surface of said cylindrical.

3. The connector pin as claimed in claim 1, wherein said electrically conductive magnetic fluid is mercury.

4. A connector pin comprising:

a cylindrical casing which is open at one end thereof and closed at the other end thereof;

a fixing table which has a side surface connected to a pin and is accommodated in said cylindrical casing;

a spring which is accommodated between the other side surface of said fixing table and the other end of said cylindrical casing;

a ball which is accommodated between said fixing table and said spring, said ball and said cylindrical casing being magnetized; and an electrically conductive magnetic fluid being sustained in said cylindrical casing.

5. The connector pin as claimed in claim 4, wherein said other side surface of said fixing table is configured as a slant surface.

6. The connector pin as claimed in claim 4, wherein said electrically conductive magnetic fluid is not filled in a central section of said cylindrical casing, but covers said ball and an inside surface of said cylindrical casing.

7. The connector pin as claimed in claim 4, wherein said electrically conductive magnetic fluid is mercury.

8. An electric connector unit for connecting first and second substrates which have connecting pads, comprising:

a first connector pin which is disposed at a location corresponding to a location of a connecting pad on said first substrate;

a second connector pin which is disposed at a location corresponding to a location of a connecting pad on said second substrate and connecting means which connects said first connector pin to said second connector pin;

each of said first connector pin and said second connector pin further comprising:

a pin being supported with a spring and movable in an elongating/contracting direction of said spring;

a cylindrical casing accommodating said pin;

a connecting member being connected to said pin and being kept in contact with an inside surface of said cylindrical casing, said connecting member and said cylindrical casing being magnetized; and an electrically conductive magnetic fluid being sustained in said cylindrical casing.

9. The electric connector unit as claimed in claim 8, wherein said electrically conductive magnetic fluid is not filled in a central section of said cylindrical casing, but covers said connecting member and said inside surface of said cylindrical casing.

10. The electric connector unit as claimed in claim 8, wherein said electrically conductive magnetic fluid is mercury.

* * * * *